United States Patent [19]

Krill

[11] Patent Number: 4,862,602

[45] Date of Patent: Sep. 5, 1989

[54] DRYING FRAME

[76] Inventor: John J. Krill, 44105 Lee Ann, Canton, Mich. 48187

[21] Appl. No.: 184,388

[22] Filed: Apr. 21, 1988

Related U.S. Application Data

[63] Continuation-in-part of Ser. No. 945,643, Dec. 23, 1986, abandoned.

[51] Int. Cl.[4] ..... F26B 25/00

[52] U.S. Cl. ..... 34/239; 34/240; 211/194; 211/188; 211/182

[58] Field of Search ..... 34/143, 151, 239; 211/194, 188, 182; 248/176

[56] References Cited

U.S. PATENT DOCUMENTS

| | | | |
|---|---|---|---|
| 2,521,100 | 9/1950 | Sublette | 232/69 |
| 2,654,487 | 10/1953 | Degener | 211/148 |
| 3,358,388 | 12/1967 | Weiss et al. | 34/239 |
| 3,964,810 | 6/1976 | Murphy | 211/188 X |
| 4,105,348 | 8/1978 | Anderson et al. | 211/182 X |
| 4,538,365 | 9/1985 | Aho | 34/239 |
| 4,630,550 | 12/1985 | Weitzman | 108/155 |

*Primary Examiner*—Henry A. Bennet
*Assistant Examiner*—John Sollecito
*Attorney, Agent, or Firm*—Charles W. Chandler

[57] ABSTRACT

A collapsible drying rack includes a series of horizontal tubular plastic frame elements connected together by corner elements. Each corner element has four hollow tubular arms that telescopically receive the frame members. A pair of integral, longitudinal ridges on each arm engage the inside of the tubular frame members to form an easily releasable connection compensating for variations in manufacturing tolerances of the plastic members. A mesh sheet mounted on the frame, supports a garment such as a sweater, in a sandwiched position for drying.

14 Claims, 3 Drawing Sheets

DRYING FRAME

CROSS REFERENCE TO RELATED APPLICATIONS

This invention is a continuation in-part of application Ser. No. 945,643 having a filing date of Dec. 23, 1986 for DRYING FRAME, now abandoned.

BACKGROUND OF THE INVENTION

This invention is related to a collapsible drying rack having particular utility for supporting garments that must be laid flat and aired during the drying process. Such racks are normally stacked so that several layers of material may be dried. Similar racks are commonly employed for a variety of articles such as pies, fruit, glue, shellac and the like.

A drying rack, generally of the type to which this invention pertains, is illustrated in U.S. Pat. No. 1,587,573 which issued to C. H. Young on June 8, 1926. Although such racks in the past have been useful for industrial processes, they are inconvenient for use in the home or for a traveler, who wants to dry a freshly cleaned garment but has limited drying facilities.

Other knock-down racks are to be found in U.S. Pat. No. 4,630,550 which issued Dec. 23, 1986 to Harry L. Weitzman; and U.S. Pat. No. 2,654,487 which issued to R. K. Degener on Oct. 6, 1953. These racks are formed of a steel material and usually used for industrial applications. Their weight is such that they cannot be easily used by travelers who need a lightweight, easily assembled, relatively compact unit.

Other drying racks specifically designed for drying garments are disclosed in U. S. Pat. No. 3,358,388 which issued to E. Weiss, et al, on Dec. 19, 1967; and U.S. Pat. No. 2,521,100 which issued to E. S. Sublette on Sept. 5, 1950. These devices support the garment between two mesh surfaces for drying.

SUMMARY OF THE INVENTION

The broad purpose of the present invention is to provide a collapsible drying rack that can be easily carried in its collapsed condition in a bag, and then readily assembled to support a mesh material on which garments may lay during the drying process.

The preferred embodiment of the invention includes a lightweight plastic corner member having short hollow arms extending in mutually perpendicular directions. Each arm has a square cross-section and a pair of longitudinal ridges which terminate a short distance from the end of the arm.

The corner members are telescopically connected to tubular, extruded plastic frame members to form a frame or rack. The ridges engage the frame member and compensate for the substantial manufacturing tolerances of plastic extrusions that do not exist with tubular steel members, such as is illustrated in the Degener and Weitzman patents.

The ridges provide little frictional resistance when the arm is being assembled or disassembled. The major frictional engagement is between the two, non-ridged sides of each arm that are in surface-to-surface contact with the frame member. The ease of assembly differs from steel racks which are normally assembled in a semi-permanent installation.

For example, in the Degener patent, the flat ridges frictionally engage with the tubes that are received in the ridged member. This is satisfactory for a relatively stiff material such as steel that is inherently stiff because of its load-bearing requirements. However, a thin walled plastic tube is not as stiff as a corresponding steel tube. The ridges of the preferred embodiment of the present invention increase the stiffness of the walls carrying the ridges because they increase the overall thickness of the wall in the ridge location.

The garment being dried is supported on a mesh sheet that is clipped to a pair of spaced parallel frame members. The garment is sandwiched flat between two mesh sheets as the garment is being air dried outdoors to keep the garment from being blown off the horizontal surface by gusts of wind.

The preferred embodiment of the invention includes a group of components that can be assembled to form a stacked configuration or an elongated horizontal configuration.

Another advantage of the invention is that the plastic material permits the consumer to readily cut the frame members to convenient lengths. The cut, exposed surfaces are not susceptible to rust or corrosion as in the case of coated metals.

The various components are extremely versatile because they can be assembled in a variety of configurations. The corner members can be employed either in a corner or in the center of the rack. The tubing can come in various lengths and assembled in a variety of configurations.

The mesh sheet has a sleeve in its midsection so that it can be combined with the tubing in at least three different configurations. Where a single surface is desired, the sleeve is mounted on one horizontal support and the free edge clipped to another horizontal support. In a side-by-side configuration, the sleeve is mounted on a horizontal support forming the frame midsection, and the opposite edges of the mesh sheet are clipped to the opposite ends of the frame. In a third configuration, the frames are stacked one above the other. One end of the mesh sheet is clipped to one end of the lower frame and the opposite end of the sheet connected to the upper frame.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
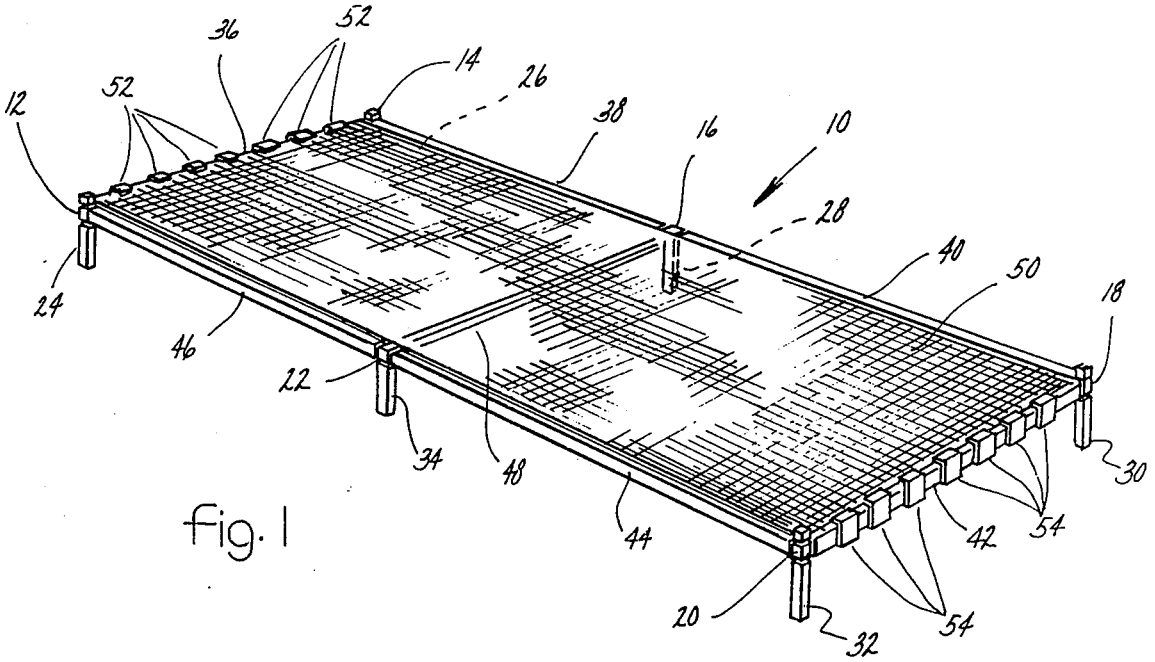
FIG. 1 is a perspective view of a collapsible drying rack illustrating the preferred embodiment of my invention formed in a pair of side-by-side frames.

FIG. 1 illustrates a preferred collapsible drying rack 10. Rack 10 includes six identically shaped, plastic, corner members 12, 14, 16, 18, 20 and 22 supported on six square, plastic, hollow tubular legs 24, 26, 28, 30, 32 and 34 respectively.

The corner members also support seven extruded plastic hollow tubular frame members 36, 38, 40, 42, 44, 46 and 48 to form an elongated, rectangular drying frame. A flexible, mesh drying sheet 50 is mounted on the drying frame.

Seven clips 52 connect one end of the mesh sheet to frame member 36. Seven clips 54 connect the opposite end of the flexible sheet to frame member 42. The sheet has a stitched sleeve 56 wrapped around frame member 48.

Figure 2:
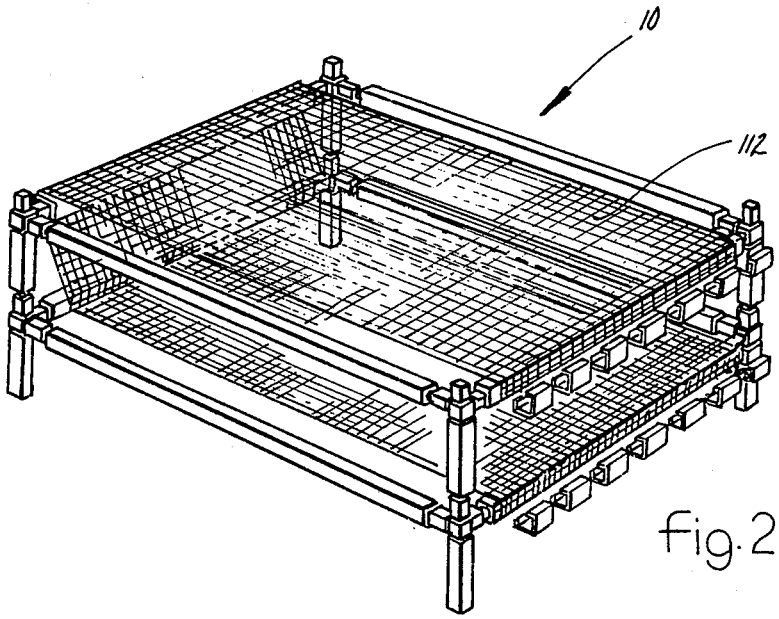
FIG. 2 is a partially exploded view of my rack showing a pair of frames stacked one above the other.

FIG. 2 shows a partially disassembled version of the preferred embodiment in which the legs, frame members and corner members cooperate to form a double stacked arrangement 110 using elements having the same configuration as is illustrated in FIG. 1.

Figure 4:
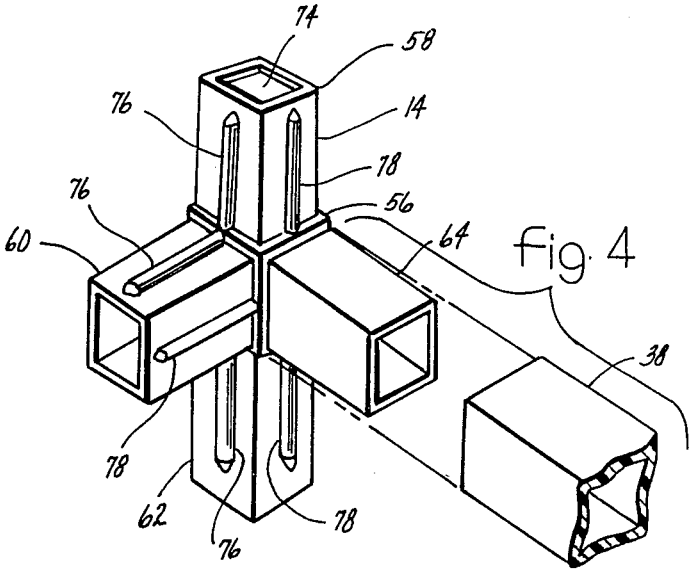
FIG. 4 is a sectional view illustrating the manner in which the frame member is telescopically engaged with a corner arm.

FIG. 4 illustrates a typical corner member 14. Corner member 14 has a central, cube-shaped body 56, and four hollow, square arms 58, 60, 62, and 64. Each arm is identical in length.

A wall 74 is mounted adjacent the extreme end of arm 58.

Each arm has a wall-to-wall outside diameter somewhat less than that of the internal diameter of the frame members. Each arm has a pair of longitudinal ridges 76 and 78 along two adjacent sidewalls. The extreme end of each ridge is spaced about ¼ from the extreme outer end of the arm on which it is mounted. Further, the extreme end of each ridge is rounded to ease the receipt of an arm in a frame member.

Figure 5:
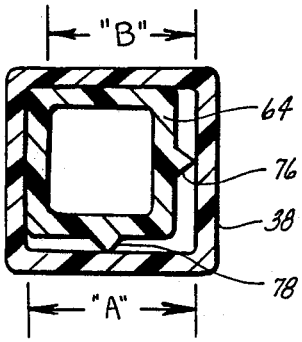
FIG. 5 is a cross-sectional view illustrating the manner in which the ridges engage the inside of a frame member.

The manner in which each arm receives a frame member is best illustrated in FIGS. 4 and 5. The inner diameter "A" of frame member 38, perpendicular to each sidewall, is slightly greater than the outer diameter "B" of the arm. However, the height of ridges 76 and 78 is such that the diameter of the arm, including the ridge, is slightly greater than the inner diameter of the frame member. Further, each ridge is parallel to the longitudinal axis of the arm on which it is mounted. Each ridge is formed on the midsection of the arm wall on which it is mounted to increase the overall thickness of the wall at such location. Thus the wall has a stiffened midsection.

As frame member 38 is being slipped over arm 64, the two ridges engage the inside surface of the frame member with a minimal frictional resistence to the assembly motion. The frame member is received on the arm until the frame member end abuts body 56. The ridges accommodate dimensional variations in the manufacturing of both the frame members and the arms. The ridges also permit the frame members and the arms to be quickly assembled and disassembled.

Figure 3:
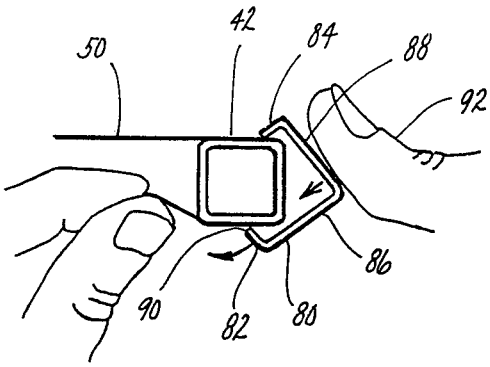
FIG. 3 is a view illustrating the manner in which a mesh sheet is clipped around a frame member.

Referring to FIG. 3, a typical clip 80 is shown being snapped over the mesh sheet which is partially wrapped around square frame member 42. The clip is a four-sided member having a short side 82 and a short side 84 connected to sides 86 and 88 so as to define an opening 90 for receiving the support. The user, mounts the clip on the opposed sides of the frame member. He then applies a pressure with his thumb 92 on the clip until it snaps around the four sides of the frame member.

The clip can be easily released by pulling on one of the short sides to separate it from the frame member.

The rack illustrated in FIG. 1 has side-by-side frames, but a single rack can be used by not assembling frame members 40 and 44.

Figure 6:
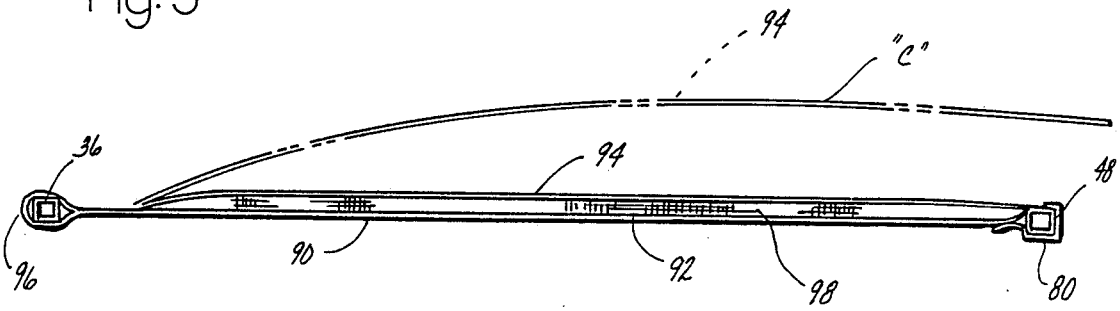
FIG. 6 is a view illustrating a garment sandwiched on a single frame.

Referring to FIG. 6, a garment, such as a sweater 94, is mounted on the lower portion 96 of the mesh sheet and the upper portion 98 of the mesh sheet is lowered from position "C" on the garment to sandwich it in a drying position.

The free edge of the mesh sheet is then wrapped around support 48, and clip means 80 snapped around the edges of the mesh sheet.

Figure 7:
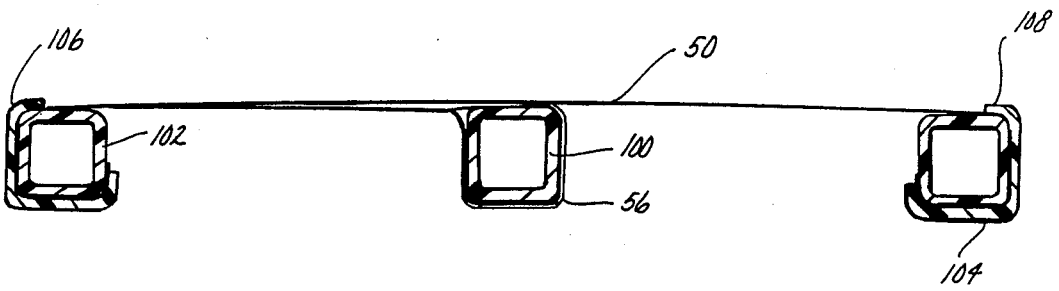
FIG. 7 is a view illustrating the mesh sheet supported in a side-by-side frame configuration.
Figure 8:
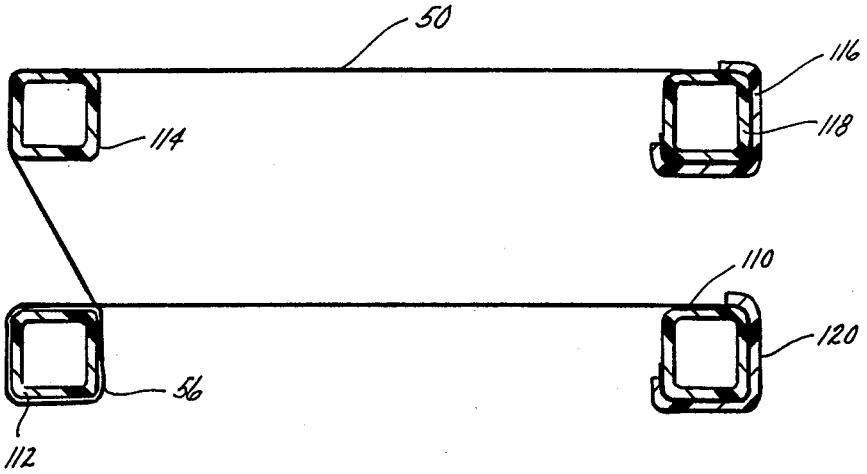
FIG. 8 is a view illustrating the mesh sheet supported in a stacked configuration.

FIGS. 7 and 8 illustrate other configurations for using the mesh sheet. In FIG. 7, sleeve 56 is mounted on intermediate frame member 100, one end of the sheet is wrapped around frame member 102 and its opposite end wrapped around frame member 104. The three frame members are parallel to one another. Clip means 106 and 108 connect the ends of the sheet to the end frame members.

FIG. 8 illustrates another arrangement in which one end of the sheet is wrapped around frame member 110, and sleeve wrapped around frame member 112 and then the opposite end of the sheet looped around frame member 114. The frame members are all parallel to one another. Clip means 116 connect one end of the sheet to frame member 118 and clip means 120 connect the opposite end to frame member 110. The sleeve is somewhat off-center on the sheet as illustrated in FIG. 8, so that one end of the sheet is longer than the others. Further, it is to be noted that because all the frame members are parallel, one to the other, the sleeve functions to square-up the mesh sheet on the frames as well as providing an initial attachment.

The clips complete the assembly of the sheet to the frame to create a surface.

Thus, it is to be understood that I have described an improved knock-down drying rack that can be assembled into different configurations, allowing several sweaters or other hand washable garments to be flat dried in a minimal amount of space. It can be assembled into racks that can be snapped together for side-by-side drying, or stacked two, three or four high to fit a standard size bathtub to save space. The flat surface prevents woven materials from stretching out-of-shape and forming creases. The entire assembly can be knocked down and stored in a 10" by 32" canvas bag (not shown) when not in use. Preferably the frame components are each formed of a high-impact styrene plastic. They can be made of other suitable plastics, such as polyvinyl chloride.

Having described my invention, I claim:

1. A collapsible structure useful as a drying rack for drying a garment or the like, comprising:

a plurality of elongated, plastic, frame members, each of said frame members including:

a four-sided, square, tubular element having a pair of walls disposed in a parallel relationship and spaced a first diameter therebetween;

each tubular element having an open end, each of said pair of walls having an inside planar surface adjacent said open end; and a corner member having a plastic body and a plurality of plastic tubular arms, each of said arms having:

an outer end;

at least a pair of spaced, parallel sidewalls, telescopically receivable in the open end of a tubular element between said pair of walls in a motion in a first direction;

an integral ridge on the outside surface of at least one of said pair of sidewalls extending in a direction parallel to said first direction;

an unridged, planar outside surface on the other of said pair of sidewalls such that the ridge is slideably disposed in contact with the inside planar surface of one of said pair of walls of the frame member, and the unridged planar outside surface of the other of said pair of sidewalls is in surface -to-surface slidable contact with the inside planar surface of the other of said pair of walls of the frame member, to form a slidable friction fit between the arm and the frame member.

2. A collapsible drying rack as defined in claim 1, in which the integral ridge increases the overall thickness of the sidewall at the location of the ridge so as to stiffen the sidewall.

3. A collapsible drying rack as defined in claim 1, in which each of said corner member arms has a pair of ridges on the outside of two of said sidewalls, each ridge having one end spaced from the extreme outer end of the arm.

4. A combination as defined in claim 1, in which the tubular frame members and the tubular arms each have a square cross-section.

5. A combination as defined in claim 1, in which the corner member has four tubular square arms.

6. A combination as defined in claim 1, in which each arm has a square cross section, and the ridge extends along the outside surface of its arm, each ridge having one end spaced from the extreme outer end of its corresponding arm.

7. A combination as defined in claim 5, in which at least one of the arms has an internal wall closing off the end thereof.

8. A combination as defined in claim 1, in which the corner member has an abutment for engaging the extreme end of the frame member as it is being slideably mounted on an arm.

9. A combination as defined in claim 1, in which the drying rack comprises at least four similarly-shaped corner members, each having at least two arms connected to the frame members to form a four-sided structure.

10. A combination as defined in claim 9, including a flexible mesh drying sheet mounted over at least two spaced frame members.

11. A collapsible drying rack for drying a garment or the like comprising:

a frame having first and second spaced parallel frame members spaced to provide an opening therebetween;

a mesh sheet having opposite end edges, and means for connecting said opposite end edges to the first frame member;

the mesh sheet having a sleeve receiving the second frame member so that the sheet forms a pair of superimposed sections;

whereby a garment may be sandwiched between the pair of superimposed sections for drying.

12. A combination as defined in claim 11, including a clip element for connecting the mesh sheet to a frame member.

13. A combination as defined in claim 12, in which the frame member is a tubular four-sided element, and the clip is a four-sided element having an opening for embracing the tubular frame member and a portion of said mesh sheets wrapped around the frame member.

14. A collapsible drying rack for drying a garment or the like, comprising:

a plurality of elongated plastic tubular frame members, each frame member having elongated parallel walls in a four-sided cross-section, each of said frame members having an inner diameter between a pair of said parallel walls, and an open end;

a corner member having a plastic body, and a plurality of plastic tubular arms, each of said arms having an outer end and sidewalls in a four-sided cross-section, and having an outer, second diameter such that each of said arms is telescopically receivable in the open end of a frame member by a motion in a first direction, each of said tubular arms having an integral ridge on the outside surface of a sidewall thereof in a direction parallel to said first direction, so as to be slideably disposed between the arm and the wall of a frame member to form a friction fit between the ridge and the surface of the frame member;

a mesh sheet having opposite end edges, and means for connecting said opposite end edges to the first frame member;

the mesh sheet having a sleeve receiving the second frame member so that the sheet forms a pair of superimposed sections;

whereby a garment may be sandwiched between the first and second mesh sheets for drying.

* * * * *